US005801630A

United States Patent [19]

Ho et al.

[11] Patent Number: 5,801,630

[45] Date of Patent: Sep. 1, 1998

[54] ARTICLE SURVEILLANCE MAGNETIC MARKER HAVING AN HYSTERESIS LOOP WITH LARGE BARKHAUSEN DISCONTINUITIES AT A LOW FIELD THRESHOLD LEVEL

[75] Inventors: Wing K. Ho, Boynton Beach, Fla.; Jiro Yamasaki, Fukuoka, Japan

[73] Assignee: Sensormatic Electronics Corporation, Boca Raton, Fla.

[21] Appl. No.: 745,683

[22] Filed: Nov. 8, 1996

[51] Int. Cl.[6] ..... G08B 13/14

[52] U.S. Cl. ..... 340/572; 340/551; 164/463; 164/462; 164/423; 420/435; 148/100; 148/122; 148/121; 148/304; 148/408; 148/425

[58] Field of Search ..... 340/551, 572; 148/403, 100, 120, 121, 122, 304, 313, 408, 425, 442; 164/463, 459, 460, 462, 423, 441, 443; 420/435, 550, 576, 590; 428/900

[56] References Cited

U.S. PATENT DOCUMENTS

| | | | |
|---|---|---|---|
| 3,853,717 | 12/1974 | Diguilio | 205/138 |
| 4,075,618 | 2/1978 | Montean | 340/572 |
| 4,607,683 | 8/1986 | Hamashima et al. | 164/463 |
| 4,660,025 | 4/1987 | Humphrey | 340/572 |
| 4,686,516 | 8/1987 | Humphrey | 340/572 |
| 4,781,771 | 11/1988 | Masumoto et al. | 148/403 |
| 4,797,658 | 1/1989 | Humphrey | 340/551 |
| 4,980,670 | 12/1990 | Humphrey et al. | 340/551 |
| 5,029,291 | 7/1991 | Zhou et al. | 340/551 |
| 5,313,192 | 5/1994 | Ho et al. | 340/551 |

OTHER PUBLICATIONS

Humphrey et al., "Re-entrant Magnetic Flux Reversal In Amorphous Wires".

Kinoshita et al., "Influence of Applied Tensile and Compressive Stress on Large Barkhausen and Matteucci Effects In Amorphous Wires," IEEE Transactions on Magnetics, vol. MAG-22, No. 5, Sep. (1986), Intermag Issue.

R. Halmhall et al., "Bistable Magnetization Reversal In 50 μm Diameter Annealed Cold-Drawn Amorphous Wires," 1987.

F.B. Humphrey et al., "Re-entrant Magnetic Flux Reversal In Amorphous Wires.".

K. Mohri et al., "Amorphous Wires," 1990.

F. Kinoshita et al., "Influence of Applied Tensile and Compressive Stress on Large Barkausen and Matteucci Effects In Amorphous Wires," IEEE Transactions on Magnetics, vol. MAG-22, No. 5, Sep. (1986), Intermag Issue.

K. Mohri et al., "Jitter-Less Pulse Generator Elements Using Amorphous Bistable Wires," IEEE Transactions on Magnetics, vol. MAG-20, No. 5, Sep. 1994.

*Primary Examiner*—Jeffery A. Hofsass
*Assistant Examiner*—Benjamin C. Lee
*Attorney, Agent, or Firm*—Robin, Blecker & Daley

[57] ABSTRACT

A harmonic-type EAS marker includes a wire segment formed of cobalt alloy. To form the wire segment, the cobalt alloy is cast as an amorphous wire, die-drawn to a smaller diameter, and then annealed with application of longitudinal tension. The annealed wire is cut to produce wire segments which have a magnetic hysteresis loop with a large Barkhausen discontinuity at a lower threshold level than has previously been achieved.

36 Claims, 5 Drawing Sheets

ARTICLE SURVEILLANCE MAGNETIC MARKER HAVING AN HYSTERESIS LOOP WITH LARGE BARKHAUSEN DISCONTINUITIES AT A LOW FIELD THRESHOLD LEVEL

FIELD OF THE INVENTION

This invention relates to magnetic markers for use in electronic article surveillance (EAS) systems and to methods, apparatus and systems for using and making such markers.

BACKGROUND OF THE INVENTION

In the design of EAS systems which use magnetic-type markers, efforts have been made to enhance the uniqueness of the marker's response. One way that this has been accomplished is by increasing the high harmonic content in the voltage pulse generated by the magnetic flux reversal of the marker. When the high harmonic content is increased, the marker's response signal becomes more easily differentiated and detectable over lower frequency background noise and magnetic shield noise and signals generated by other magnetic materials often found to exist in EAS systems.

In U.S. Pat. No. 4,660,025, entitled "Article Surveillance Magnetic Marker Having An Hysteresis Loop With Large Barkhausen Discontinuities" (assigned to the assignee of this application), a magnetic marker is disclosed which develops an output pulse that is substantially independent of the time rate of change of the interrogating field and the field strength as long as the field strength exceeds a minimum threshold value. More particularly, the '025 patent teaches that by forming the marker so that the magnetic material of the marker retains stress, the marker exhibits a hysteresis characteristic having a large Barkhausen discontinuity. Accordingly, upon exposure to an interrogating field exceeding the threshold value, the magnetic polarization of the marker undergoes a regenerative reversal. This so-called "snap action" reversal in the magnetic polarization results in the generation of a sharp voltage pulse, rich in high harmonics, which affords a signal that can be distinguished from background noise and signals generated by magnetic materials other than EAS markers.

The disclosure of U.S. Pat. No. 4,660,025, and of related U.S. Pat. No. 4,686,516, is incorporated herein by reference.

FIG. 1 illustrates a hysteresis loop characteristic of the marker disclosed in the '025 patent. Indicated at 20 and 22 in FIG. 1 are large and substantially instantaneous reversals in magnetic polarity exhibited by the magnetic material disclosed in the '025 patent. These reversals are referred to as "Barkhausen discontinuities" and occur at a magnetizing field threshold level having the magnitude $H_T$. As long as the incident alternating interrogation field has a magnitude which exceeds the threshold level $H_T$, the marker will exhibit a very sharp signal spike, rich in high harmonic frequencies that are readily detectable by the EAS system.

The '025 patent discloses, as a particular example of a suitable magnetic material, an amorphous wire segment having the composition $Fe_{81}Si_4B_{14}C_1$, where the percentages are in atomic percent. The threshold for the material was less than 0.6 Oe. Thus, this particular material generated a sharp spike even when the incident interrogation field had a peak amplitude of 0.6 Oe.

The actual strength of the incident interrogation field signal experienced by a marker in an interrogation zone of an EAS system may vary substantially from place to place within the zone. The field strength ranges from a maximum at locations adjacent to the interrogation signal transmission antenna or antennas, to much lower levels at points in the interrogation zone that are relatively distant from the antenna(s). If a marker of the type disclosed in the '025 patent is exposed to an interrogation signal that has an amplitude lower than the threshold level $H_T$ of the hysteresis loop for the material, then the desired sharp spike output is not generated. Although magnetic materials having threshold levels as low as about 0.04 Oe are known, the lowest reported threshold for wire segments actually employed in EAS markers is about 0.08 Oe. The incident interrogation field signal level present at some points in the interrogation zone may be below the threshold, so that the Barkhausen switch does not occur and the marker is not detectable when at such points in the zone.

It could be contemplated to increase the strength of the signal radiated from the interrogation antenna(s) to ensure that the entire interrogation zone is subject to a signal level higher than the threshold, but this approach may cause undesirable heating effects in the antenna driving circuitry and/or may require the circuitry to include relatively high cost components. In addition, increasing the radiated field strength may be prevented by relevant regulatory constraints.

As another alternative, the dimensions of the interrogation zone may be reduced, again to ensure that the interrogation signal level exceeds the threshold level throughout the zone. However, this approach may not be acceptable to operators of the systems and their customers, since reducing the interrogation zone can be accomplished only by narrowing the exits from premises at which the EAS system is employed.

OBJECTS AND SUMMARY OF THE INVENTION

It is an object of the invention to provide an EAS marker that has a highly unique response characteristic and is readily detectable without increasing the radiated amplitude of the interrogation field signal or decreasing the size of the interrogation zone.

According to an aspect of the invention, there is provided a marker for use in an article surveillance system in which an alternating magnetic field is established in a surveillance region and an alarm is activated when a predetermined perturbation to the field is detected, the marker including a body of magnetic material with retained stress and having a magnetic hysteresis loop with a large Barkhausen discontinuity such that exposure of the body to an external magnetic field, whose field strength in the direction opposing the magnetic polarization of the body exceeds a predetermined threshold value, results in regenerative reversal of the magnetic polarization, and structure for securing the body to be maintained under surveillance, with the predetermined threshold level being less than 0.04 Oe. In a preferred embodiment, the predetermined threshold level is substantially 0.02 Oe.

According to another aspect of the invention, the magnetic body for such a marker is formed by casting a metal alloy to form an amorphous metal wire, die-drawing the wire to reduce a diameter thereof, and annealing the drawn wire while applying longitudinal tension to the drawn wire, where the metal alloy exhibits negative magnetostriction. In a preferred embodiment of the invention, the alloy is cobalt-based, including more than 70% cobalt by atomic percent.

According to another aspect of the invention, the process for forming the magnetic body includes casting a negative-magnetostrictive metal alloy to form an amorphous metal wire, processing the wire to form longitudinal compressive stress in the wire, and annealing the processed wire to relieve some of the longitudinal compressive stress.

With a marker provided in accordance with the invention, the effective switching threshold at which the Barkhausen discontinuities occur is reduced to approximately one-half of the lowest previously-known threshold level. The resulting markers can be detected with substantially greater reliability, even when present at a point in an interrogation zone where the incident interrogation signal strength is at a minimum level.

The present invention is a remarkable departure from the prior art in that it has not previously been known to tension-anneal a cobalt-based wire to produce a wire segment which exhibits a Barkhausen discontinuity. Although positive magnetostrictive materials, such as iron-based amorphous wire, have been tension-annealed to form the longitudinal anisotropy which produces Barkhausen discontinuities, cobalt wire exhibits negative magnetostriction, and tension-annealing therefore tends to eliminate longitudinal anisotropy. The prior art has never proposed to tension-anneal cobalt wire when a Barkhausen discontinuity is desired, since the Barkhausen effect is eliminated if the longitudinal anisotropy is destroyed. According to a key finding of the present invention, it is possible to tension-anneal a cobalt-based amorphous wire, with appropriate process parameters and after die-drawing, to produce wire segments that exhibit Barkhausen discontinuities. Moreover such a process can produce a desirably low switching threshold, and a high squareness ratio. Examples of suitable process parameters are given in a subsequent section hereof.

BRIEF DESCRIPTION OF THE DRAWINGS

FIG. 3(*b*) is a signal trace showing the hysteresis loop of the material of FIG. 3 (*a*), when driven with a high-amplitude field.

FIG. 4(*b*) is the corresponding signal trace for the material of FIG. 4(*a*) when driven with a high-amplitude field.

FIG. 5(*b*) is the corresponding signal trace when the material of FIG. 5(*a*) is driven with a higher-amplitude field.

DESCRIPTION OF PREFERRED EMBODIMENTS

Figure 1:
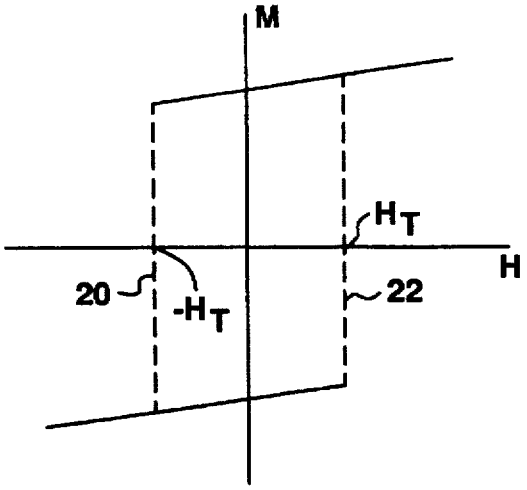
FIG. 1 is a hysteresis curve including large Barkhausen discontinuities and illustrative of magnetic characteristics of a marker provided in accordance with the prior art.
Figure 2:
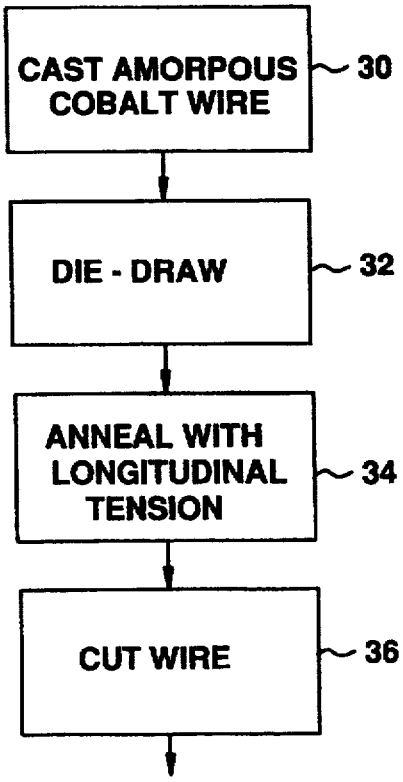
FIG. 2 is a process flow diagram which illustrates in general terms a method of forming an EAS marker element in accordance with the invention.

FIG. 2 provides an overview, in flow-diagram form, of a process carried out in accordance with the invention to produce EAS markers which exhibit a large Barkhausen discontinuity at a very low field threshold level.

The process of FIG. 2 begins with a first step, represented by block 30, in which a cobalt-based alloy is cast to form an amorphous wire. A conventional casting process such as in-rotating-water quenching may be employed.

Following step 30 is step 32, at which the cast wire is cold drawn to reduce the diameter thereof. The die-drawing step produces longitudinal compressive stress in the wire, which forms a longitudinal anisotropy and also tends to elevate the threshold level for resulting marker elements.

Following step 32 is step 34, at which the die-drawn wire is annealed while applying longitudinal tension to the wire. This annealing step, if performed with suitable parameters, relieves and redistributes some of the compressive stress produced by the die-drawing, and greatly reduces the threshold level at which the Barkhausen discontinuity occurs, while preserving a substantial output signal level.

After step 34, a step 36 is performed, in which the annealed wire is cut into discrete wire segments suitable for inclusion in a marker.

As an alternative to the die-drawing step 32, it is contemplated to substitute other process steps which produce longitudinal compressive stress in the cast wire.

MAGNETIC CHARACTERISTICS OF DIE-DRAWN WIRE SEGMENT

Figure 3A:
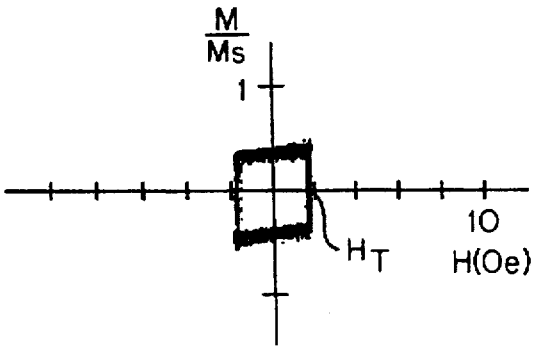
FIG. 3(*a*) is a signal trace indicative of the hysteresis loop characteristic exhibited by a material produced at the die-drawing step of FIG. 2 and excited with a low-amplitude incident field.
Figure 3B:
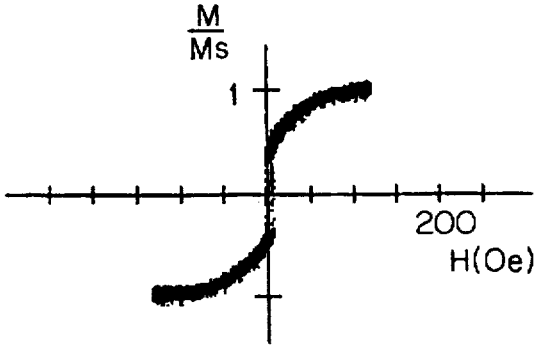

A preferred embodiment of the process of FIG. 2 is applied to an alloy having the composition $C0_{72.5}Si_{12.5}B_{15}$. The material is cast to a diameter of 125 micrometers and then die-drawn to reduce the diameter to 50 micrometers. FIGS. 3(*a*) and 3(*b*) show signal traces obtained by driving a 70 mm length of the die-drawn wire with fields having respective peak amplitudes of 2 Oe and about 120 Oe. In both FIGS. 3(*a*) and (*b*), the abscissa axis corresponds to the incident magnetic field applied along the length of the wire segment, and the ordinate axis corresponds to the resulting normalized magnetization level (magnetization level divided by magnetization at saturation ($M_s$)) As seen from FIG. 3 (*a*), a large Barkhausen discontinuity occurs at a threshold level $H_T$ of about 2 Oe. The die-drawn material exhibits a squareness ratio (remanent magnetization at zero applied field, divided by $M_s$) of about 0.35.

MAGNETIC CHARACTERISTICS OF TENSION-ANNEALED WIRE SEGMENT—EXAMPLE 1

In a preferred practice according to the invention, the die-drawn wire described just above is annealed (before cutting) for one hour at 440° C. while applying longitudinal tension to the wire. The longitudinal tension may be applied by a conventional technique such as suspending a body of the desired mass from one end of the wire and holding the other end of the wire fixed. A preferred tension is 25 $kg/mm^2$.

Figure 4A:
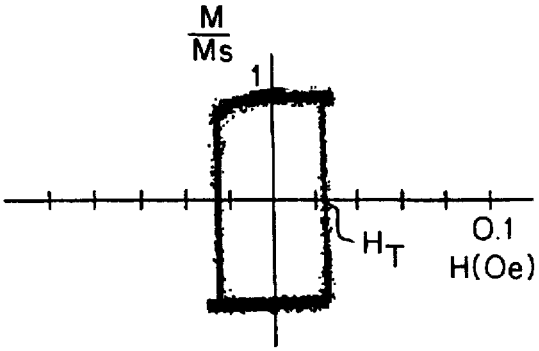
FIG. 4(*a*) is a signal trace showing the hysteresis loop of a material formed when the annealing step of FIG. 2 is performed at a certain temperature, and the material is driven with a low amplitude field.
Figure 4B:
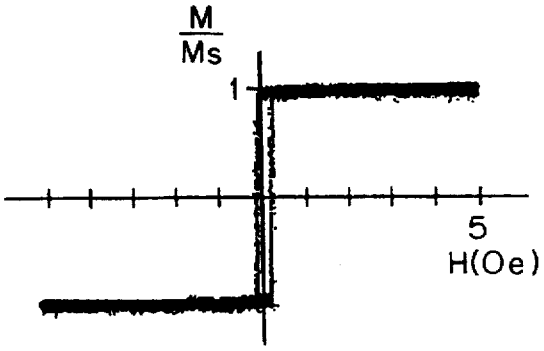

After annealing, the wire is cut to a length of 70 mm to produce an element having a hysteresis characteristic as shown in FIGS. 4(*a*) and (*b*). FIG. 4(*a*) shows the signal trace produced with a low-level driving field and FIG. 4(*b*) shows the signal trace produced with a high-level driving field.

As seen from FIG. 4(*a*), the resulting wire segment has a switching threshold $H_T$ of slightly more than 0.02 Oe. This represents a reduction in the threshold level by a factor of two in comparison with the lowest levels of $H_T$ that have previously been reported. In addition, a squareness ratio of 0.95 was achieved, which provides for an ample output signal level. It is believed that previously reported levels of $H_T$ in the range of 0.04 or 0.045 Oe have been achieved only with a substantially lower squareness ratio and by processes that may not be suitable for large-scale implementation.

The amorphous cobalt wire, as cast, has a threshold of about 0.05 Oe, but exhibits a very low output amplitude which is undesirable for use in a marker in its as-cast form. The subsequent die-drawing generates a large longitudinal compressive stress in the core of the wire. The compressive stress creates a longitudinal anisotropy in the wire, due to the negative magnetostriction exhibited by the cobalt material. Although the induced longitudinal anisotropy increases the threshold level (as shown in FIG. 3(*a*)), the subsequent longitudinal-tension annealing, if performed with suitable parameters, is believed to relieve and redistribute some of the longitudinal compressive stress, so that the desired low threshold level for the Barkhausen discontinuity is obtained, with a suitably high output level.

It has been found that if the temperature during the annealing is not sufficiently high, then not enough of the compressive stress is relieved or redistributed, so that the threshold level remains higher than is desired. On the other hand, if too high an annealing temperature is employed, then crystallization results, and the output signal level is greatly reduced. Moreover, if an excessive amount of tension is applied during annealing, then a shear hysteresis loop results, apparently because all of the compressive stress is relieved and strong longitudinal stress is annealed in.

TENSION-ANNEALING—EXAMPLE 2

Figure 5A:
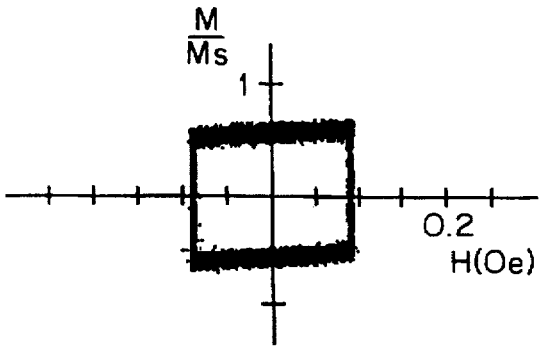
FIG. 5(*a*) is a signal trace illustrating the hysteresis loop characteristic of the same material annealed at a second temperature, when the material is driven with a low-amplitude field.
Figure 5B:
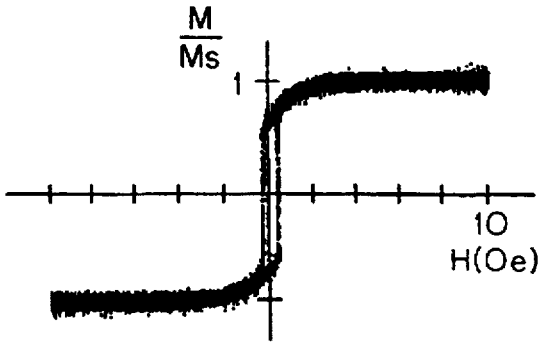

FIGS. 5(*a*) and (*b*) are signal traces representing the hysteresis loop of a discrete segment of a wire material formed when the same continuous die-drawn cobalt-alloy wire is annealed for the same time period and with the same longitudinal tension as in Example 1, but at a temperature of 380° C. The trace of FIG. 5(*a*) shows the hysteresis loop when a low-level driving signal is used, and the trace of FIG. 5(*b*) shows the hysteresis loop resulting from a higher-level driving field.

As seen from FIG. 5(*a*) the switching (Barkhausen discontinuity) threshold is about 0.1 Oe, roughly five times higher than the threshold of the material produced in Example 1. Further, the squareness ratio of the material of this Example 2 is about 0.6, substantially less than the squareness ratio for the Example 1 material. It is believed that the annealing temperature of 380° was too low to achieve sufficient relief and redistribution of the longitudinal compressive stress.

TENSION-ANNEALING—EXAMPLE 3

Figure 6:
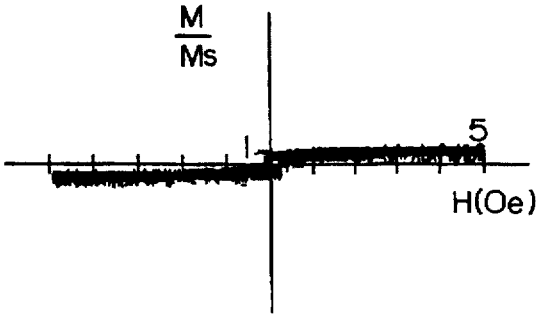
FIG. 6 is a signal trace which indicates the hysteresis loop characteristic of a material formed when the annealing step of FIG. 2 is performed at a third temperature.

FIG. 6 shows a signal trace indicative of the hysteresis loop obtained by applying the same annealing process to the die-drawn cobalt-alloy wire, but at a temperature of 520° C. It is believed that the material was crystallized in this annealing process, resulting in the indicated very low output signal level.

TENSION-ANNEALING—EXAMPLE 4

Figure 7:
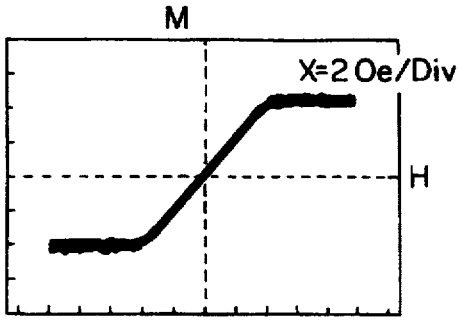
FIG. 7 is a signal trace which shows the hysteresis loop characteristic of the material when the annealing step of FIG. 2 is accompanied by application of a high level of tension to the magnetic material.

FIG. 7 shows a signal trace indicating the hysteresis loop for the same material as in Example 1, but with a longitudinal tension of 75 $kg/mm^2$ applied during annealing. The annealing time and temperature were unchanged from Example 1. It is seen that the trace in FIG. 7 shows a shear hysteresis loop, which lacks the desired Barkhausen discontinuity. In view of the negative magnetostriction exhibited by the cobalt based material, it is believed that the large longitudinal tension applied in this Example results in a circumferential anisotropy, which produces the shear hysteresis loop shown in FIG. 7.

EFFECTS OF VARIATION IN TENSION APPLIED DURING ANNEALING

Figure 8:
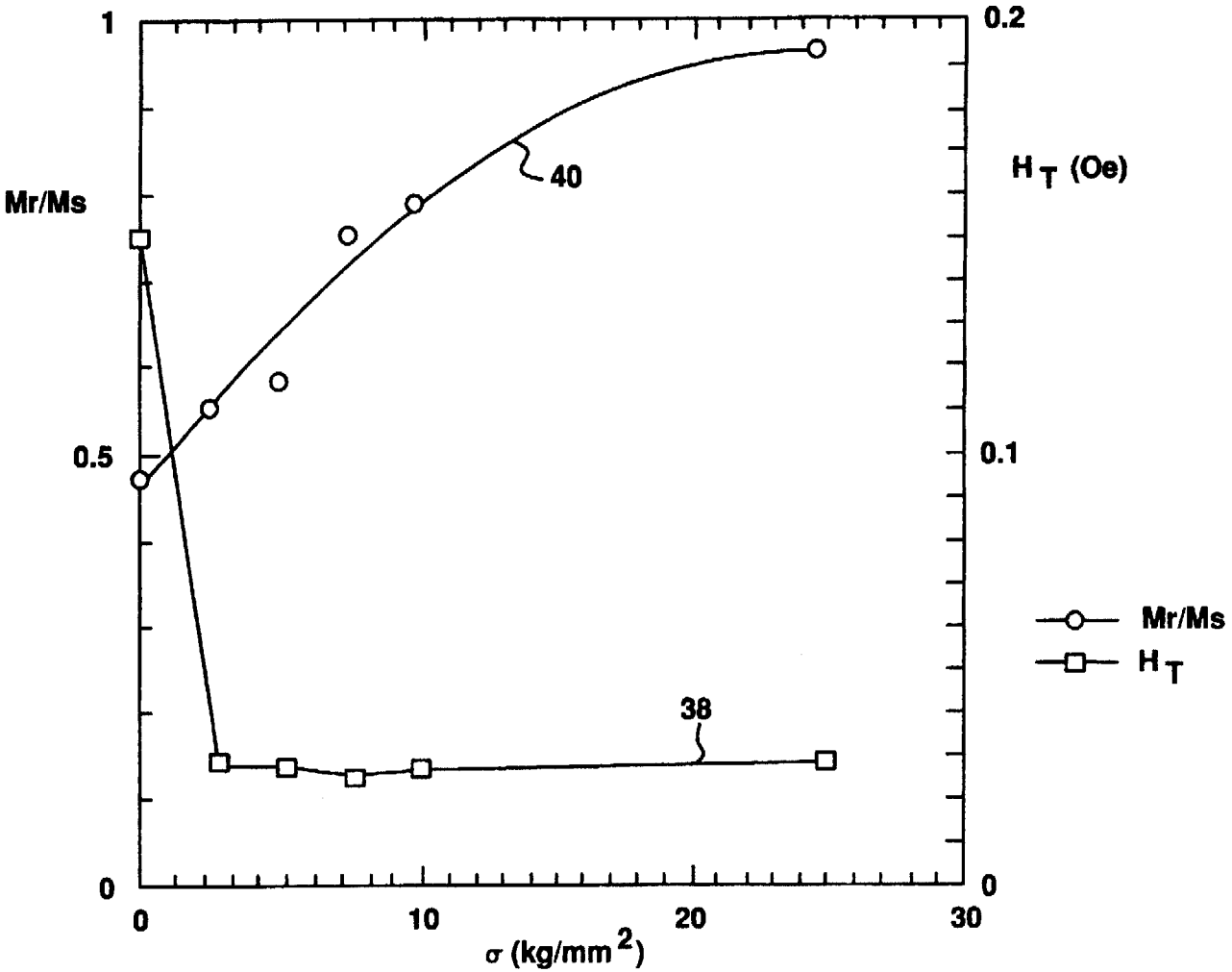
FIG. 8 graphically illustrates how variations in the level of tension applied during the annealing step of FIG. 2 cause changes in the squareness ratio and threshold level for the resulting magnetic material.

FIG. 8 illustrates how variations in the amount of longitudinal tension applied during the annealing step affect the squareness ratio and threshold levels for the resulting wire segments. For the results shown in FIG. 8, the applied longitudinal tension was varied within a range from 0 to 25 $kg/mm^2$, while employing the same material and the same time and temperature parameters as in Example 1.

Curve 38 in FIG. 8 graphs the resulting Barkhausen discontinuity threshold levels as a function of the applied longitudinal tension, and curve 40 indicates the resulting squareness level as a function of applied longitudinal tension. It will be observed that the resulting threshold level remains essentially unchanged, and at a level below 0.03 Oe, over the range of tensions 2 $kg/mm^2$ to 25 $kg/mm^2$. If the tension is omitted, the threshold remains well above 0.1 Oe. Meanwhile, the squareness ratio increases from less than 0.6 to well over 0.9 as the tension is increased from 2 $kg/mm^2$ to 25 $kg/mm^2$.

It has been found that an annealing temperature within the range of 420° C. to 500° C., and an applied longitudinal tension in the range 2 to 25 $kg/mm^2$, produces the desired magnetic material that has a low switching threshold $H_T$ and a high output signal level.

As an alternative to the specific composition given above in connection with Example 1, it is believed that satisfactory results can be obtained with other alloy compositions which include cobalt in the range of 70% to 80%, by atomic percent. For example, it is believed that $Co_{77.5}Si_{7.5}B_{15}$ would be a suitable composition.

It has been found that applying a tension of much more than the preferred level of 25 $kg/mm^2$ during annealing tends to eliminate the desired Barkhausen discontinuity. For example, applying tension at 37.5 $kg/mm^2$ was found to eliminate the desired discontinuous hysteresis characteristic.

Figure 9:
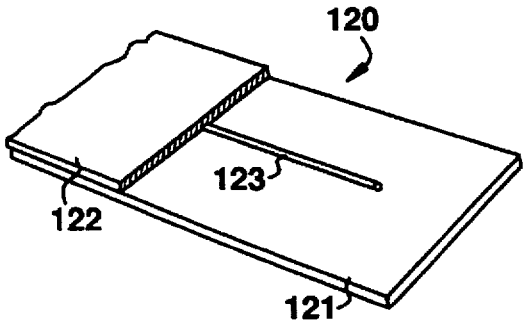
FIG. 9 is a perspective view with portions broken away of a magnetic marker formed using a wire segment produced in accordance with the present invention.

FIG. 9 shows a marker 120 constructed using the low-threshold magnetic material produced in accordance with the invention. The marker 120 includes a wire segment 123, like that produced in Example 1. The wire segment 123 is sandwiched between a substrate 121 and an overlayer 122. The undersurface of the substrate 121 may be coated with a suitable pressure sensitive adhesive to secure the marker 120 to an article which is to be maintained under surveillance.

Alternatively, other known arrangements may be employed to secure the marker to the article.

Figure 10:
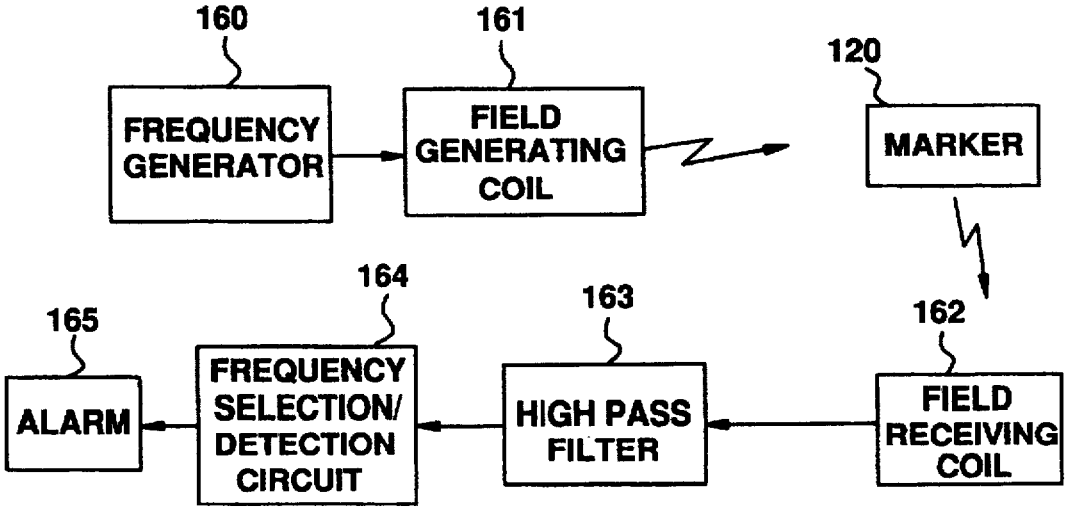
FIG. 10 is a block diagram of a typical system for establishing a surveillance field and detecting a marker produced in accordance with the invention.

A system used to detect the presence of the marker 120 is shown in block diagram form in FIG. 10. In addition to the marker 120, the system includes a frequency generator block 160 and a coil 161 for radiating the interrogation signal. Also included in the system are a receiving coil 162, a high pass filter 163, a frequency selection/detection circuit 164, and an alarm device 165. In operation, the frequency generator 160 drives the field generating coil 161 to radiate an interrogation signal field in the interrogation zone. When the marker 120 is present in the interrogation zone, resulting perturbations in the field are received by the field receiving coil 162. The output of the receiving coil 162 is passed through the high pass filter 163, which has a suitable cutoff frequency to provide high harmonic frequencies of interest to the selection/detection circuit 164. The selection/detection circuit 164 is arranged so that, when the high harmonic frequencies are present at a sufficient amplitude, an output is provided to activate the alarm device 165.

With the low threshold and high output level characteristics of the marker formed in accordance with the invention, reliable detection of the marker can be achieved, even if the marker passes through portions of the interrogation zone at which the interrogation signal is at a low level. It therefore is not necessary to increase the amplitude of the interrogation field provided by the generating coil 161, nor to reduce the size of the interrogation zone, in order to achieve increased reliability in detecting the marker.

It is contemplated that markers produced in accordance with the invention may be deactivated by crystallizing some or all of the bulk of the wire 123, as taught in the above-referenced U.S. Pat. No. 4,686,516.

Although the present invention has been described with reference to presently preferred embodiments and practices, it should be understood that various changes can be made without departing from the true spirit of the invention as defined in the appended claims.

What is claimed is:

1. A marker for use in an article surveillance system in which an alternating magnetic field is established in a surveillance region and an alarm is activated when a predetermined perturbation to said field is detected, said marker comprising a body of magnetic material with retained stress and having a magnetic hysteresis loop with a large Barkhausen discontinuity such that exposure of said body to an external magnetic field, whose field strength in the direction opposing the magnetic polarization of said body exceeds a predetermined threshold value, results in regenerative reversal of said magnetic polarization, and means for securing said body to an article to be maintained under surveillance, characterized in that said predetermined threshold level is less than 0.04 Oe.

2. A marker according to claim 1, wherein said predetermined threshold level is less than 0.03 Oe.

3. A marker according to claim 2, wherein said predetermined threshold level is substantially 0.02 Oe.

4. A marker according to claim 1, wherein said body comprises a length of amorphous metal wire.

5. A marker according to claim 4, wherein said wire is at least 70% cobalt by atomic percent.

6. A marker according to claim 5, wherein the metallurgical composition of said wire is essentially given by the formula $Co_{72.5}Si_{12.5}B_{15}$, where the percentages are in atomic percent.

7. A marker for use in an article surveillance system in which an alternating magnetic field is established in a surveillance region and an alarm is activated when a predetermined perturbation to said field is detected, said marker comprising a body of magnetic material characterized in that the magnetic polarity thereof commences and completes reversal when the magnitude of strength of said field attains a given value, without need for increase in field strength above said given value;

further characterized in that said given value is less than 0.04 Oe.

8. A marker according to claim 7, wherein said given value is less than 0.03 Oe.

9. A marker according to claim 8, wherein said given value is substantially 0.02 Oe.

10. A marker according to claim 7, wherein said magnetic material is at least 70% cobalt by atomic percent.

11. A method of forming a magnetic material, comprising the steps of:

casting a metal alloy to form an amorphous metal wire which exhibits negative magnetostriction;

die-drawing said wire to reduce a diameter thereof; and annealing the drawn wire while applying longitudinal tension to the drawn wire.

12. A method according to claim 11, wherein said metal alloy is at least 70% cobalt by atomic percent.

13. A method according to claim 12, wherein the metallurgical composition of said metal alloy is essentially given by the formula $Co_{72.5}Si_{12.5}B_{15}$, where the percentages are in atomic percent.

14. A method according to claim 11, wherein said annealing step is performed at a temperature in the range 420° to 500° C.

15. A method according to claim 14, wherein said annealing step is performed at a temperature of substantially 440° C.

16. A method according to claim 11, wherein said tension applied during said annealing step is in the range of 2 to 25 $kg/mm^2$.

17. A method according to claim 16, wherein said tension applied during said annealing step is substantially 25 $kg/mm^2$.

18. A method according to claim 11, wherein the wire formed by said casting step has a diameter of substantially 125 micrometers and said die-drawing step reduces the diameter to substantially 50 micrometers.

19. A method according to claim 18, wherein:

the metallurgical composition of said alloy is essentially given by the formula $Co_{72.5}Si_{12.5}B_{15}$, where the percentages are in atomic percent; and said annealing step is performed at a temperature of substantially 440° C.; and said tension applied during said annealing step is substantially 25 $kg/mm^2$.

20. A method according to claim 11, wherein said die-drawing step produces longitudinal compressive stress in said wire, and said annealing step is performed so as to relieve some but not all of said longitudinal compressive stress.

21. A marker for use in an article surveillance system in which an alternating magnetic field is established in a surveillance region and an alarm is activated when a predetermined perturbation to said field is detected, said marker comprising a body of magnetic material with retained stress and having a magnetic hysteresis loop with a large Barkhausen discontinuity such that exposure of said body to an external magnetic field, whose field strength in the direction opposing the magnetic polarization of said body exceeds a predetermined threshold value, results in regenerative reversal of said magnetic polarization, and means for securing said body to an article to be maintained under surveillance;

characterized in that said body of magnetic material is formed by casting a metal alloy to form an amorphous metal wire which exhibits negative magnetostriction, die-drawing the cast wire to reduce a diameter thereof, annealing the drawn wire while applying longitudinal tension to the drawn wire, and cutting the annealed wire to form a discrete wire segment.

22. A marker according to claim 21, wherein said alloy is at least 70% cobalt by atomic percent.

23. A marker according to claim 22, wherein said annealing is performed at a temperature in the range 420° to 500° C., and said longitudinal tension is in the range 2 to 25 $kg/mm^2$.

24. A marker according to claim 23, wherein said die-drawing reduces the diameter of the cast wire from substantially 125 micrometers to substantially 50 micrometers.

25. A marker according to claim 24, wherein:

the metallurgical composition of said metal alloy is essentially given by the formula $Co_{72.5}Si_{12.5}B_{15}$, where the percentages are in atomic percent; and said annealing is performed at a temperature of substantially 440° C. and with said applied longitudinal tension at substantially 25 $kg/mm^2$.

26. An article surveillance system for detection of the presence of an article in an interrogation zone comprising:

a. generator means for generating an incident alternating magnetic field within an interrogation zone;

b. a marker secured to an article, said marker comprising a body of magnetic material with retained stress and having a magnetic hysteresis loop with a large Barkhausen discontinuity such that upon exposure of said body to an external magnetic field, whose field strength in the direction opposing the instantaneous magnetic polarization of said body exceeds a predetermined threshold value, there results a regenerative reversal of said magnetic polarization, said marker characterized in that said predetermined threshold level is less than 0.04 Oe; and c. receiving means for detecting perturbations of the magnetic field in said interrogation zone when said marker is present in said interrogation zone.

27. An article surveillance system according to claim 26, wherein said predetermined threshold is less than 0.03 Oe.

28. An article surveillance system according to claim 27, wherein said predetermined threshold is substantially 0.02 Oe.

29. An article surveillance system according to claim 26, wherein said body of magnetic material is formed of a cobalt alloy.

30. An article surveillance system according to claim 29, wherein said body of magnetic material is formed by casting a cobalt alloy to form an amorphous metal wire, die-drawing the cast wire to reduce a diameter thereof, annealing the drawn wire while applying longitudinal tension to the drawn wire, and cutting the annealed wire to form a discrete wire segment.

31. An article surveillance system according to claim 30, wherein said wire is at least 70% cobalt by atomic percent.

32. A method of forming a magnetic material, comprising the steps of:

casting a metal alloy to form an amorphous metal wire which exhibits negative magnetostriction;

processing said wire to form longitudinal compressive stress in said wire; and annealing the processed wire to relieve some of the longitudinal compressive stress.

33. A method according to claim 32, further comprising the step of applying longitudinal tension to said wire during the annealing step.

34. A method according to claim 32, wherein said processing step includes die-drawing the cast wire to reduce a diameter thereof.

35. A method according to claim 32, wherein the metal alloy is at least 70% cobalt by atomic percent.

36. A method according to claim 35, wherein the metallurgical composition of said alloy is essentially given by the formula $Co_{72.5}Si_{12.5}B_{15}$, where the percentages are in atomic percent.

* * * * *

UNITED STATES PATENT AND TRADEMARK OFFICE

CERTIFICATE OF CORRECTION

PATENT NO. : 5,801,630

DATED : Sept. 1, 1998

INVENTOR(S) : Wing K. Ho, et al

It is certified that error appears in the above-identified patent and that said Letters Patent is hereby corrected as shown below:

Col. 4, line 48, delete "CO" and insert --Co--

Signed and Sealed this

Seventh Day of September, 1999

*Attest:*

Q. TODD DICKINSON

*Attesting Officer*

*Acting Commissioner of Patents and Trademarks*